United States Patent [19]

Pado

[11] Patent Number: 4,721,055

[45] Date of Patent: Jan. 26, 1988

[54] REMOTELY OPERATED UNDERWATER VEHICLE

[75] Inventor: John T. Pado, Leeming, Australia

[73] Assignee: Underwater Systems Australia Limited, Perth, Australia

[21] Appl. No.: 781,271

[22] PCT Filed: Jan. 17, 1985

[86] PCT No.: PCT/AU85/00008

§ 371 Date: Oct. 9, 1985

§ 102(e) Date: Oct. 9, 1985

[87] PCT Pub. No.: WO85/03269

PCT Pub. Date: Aug. 1, 1985

[30] Foreign Application Priority Data

Jan. 17, 1984 [AU] Australia ..... PG3231

[51] Int. Cl.[4] ..... B63G 8/00

[52] U.S. Cl. ..... 114/331; 114/330; 114/332; 441/25

[58] Field of Search ..... 441/121, 23–26; 114/312, 330–333, 337, 338

[56] References Cited

U.S. PATENT DOCUMENTS

| | | | |
|---|---|---|---|
| 3,492,962 | 2/1970 | Brainard | 114/330 |
| 3,500,648 | 3/1970 | Daniell | 114/331 |
| 3,527,184 | 9/1970 | McCarty | 114/331 |
| 3,625,171 | 12/1971 | Bailey | 114/330 |
| 3,635,183 | 1/1972 | Keatinge | 114/330 |
| 3,675,607 | 7/1972 | Dorschel | 114/331 |
| 3,880,103 | 4/1975 | Tarkington | 405/185 |
| 3,965,512 | 6/1976 | Bennett | 441/25 |
| 3,987,745 | 10/1976 | Chaverebiere | 367/106 |
| 4,096,598 | 6/1978 | Mason | 441/25 |
| 4,246,671 | 7/1981 | Swenson | 441/25 |
| 4,455,962 | 6/1984 | Gongwer | 114/330 |
| 4,580,987 | 4/1986 | Walden | 441/25 |

*Primary Examiner*—Joseph F. Peters, Jr.
*Assistant Examiner*—Clifford T. Bartz
*Attorney, Agent, or Firm*—Murray and Whisenhunt

[57] ABSTRACT

A remotely operated submersible vehicle (21), wherein the vehicle includes flotation cells (62) to provide positive buoyancy, and the vehicle is connected to a disposable clump weight (22) of sufficient weight to overcome the positive buoyancy. The connection between the clump weight and the vehicle is by way of a cable (25) which can be wound onto and off from a drum winch (45) within the vehicle to control its height off the seabed (23). The trim of the vehicle is maintained by adjusting the horizontal position of a cable guide (43) through which the clump weight cable (22) passes, the cable guide (43) being moved longitudinally and transversed by hydraulic cylinders (47). Control signals to control and monitor the operation vehicle are provided via an umbilical cable (29) extending from a ship (76) or platform on the surface. As well as operating with the clump weight (22) on the seabed (23), the vehicle (21) can be made to operate in a 'free swimming' mode by selecting a clump weight (22) which only just overcomes the positive buoyancy of the flotation cells (62), positioning the weight to provide a bow up attitude and using a vertical thrust component produced by the thrusters (48) when the vehicle is in the bow up attitude to lift the vehicle from the seabed (23).

17 Claims, 6 Drawing Figures

REMOTELY OPERATED UNDERWATER VEHICLE

TECHNICAL FIELD

The present invention relates to remotely operated underwater vehicles which are used for site preparation, maintenance and repair operations in connection with sea bed oil drilling rigs.

BACKGROUND ART

Remotely operated vehicles (ROVs) which have been used in the past are of a type wherein a deployment cage is suspended from a surface vessel, and the vehicle is teathered to the cage, the vehicle being of substantially neutral buoyancy and therefore able to adjust its own vertical position by slightly altering its buoyancy.

With such prior art arrangements, the lifting capacity of the ROV is determined by the degree of positive buoyancy which it can attain, and therefore lifting capacity is usually relatively low. Further, since at least a part of the weight of the teather between the ROV and the deployment cage must be borne by the ROV, it is necessary to use a relatively light teather cable and as this cable incorporates all of the electrical wiring between the ROV and the deployment cage, breakages of signal wiring often occur. This problem is accentuated by continual flexing of the teather due to the heaving motion of the deployment cage, which is caused by the motion of the surface vessel in response to swell and chop.

Another problem which can be experienced with ROVs is that as the amount of instrumentation in the ROV is increased, the size of the teather and umbilical cables increase due to the requirement for more wiring to carry signals back and forth between the ROV and remote surveillance and control panels in the surface vessel. One known method of overcoming this problem is to use signal multiplexers and demultiplexers to reduce the number of signal wires required, however, such equipment is relatively complex and expensive and in the event of equipment failure can lead to long down times and costly spare parts inventories.

DISCLOSURE OF THE INVENTION

The present invention consists in a remotely operated submersible vehicle, the vehicle comprising positive buoyancy means, a winch, a cable stored on said winch and passing through guide means, said cable being adapted to have a clump weight attached to a free end thereof, such that when said clump weight is made sufficiently heavy to overcome the buoyancy of the positive buoyancy means, the vertical position of the vehicle from a sea bed over which it is operating can be adjusted by winding cable onto, or off from, said winch, the guide means being horizontally movable within the vehicle to maintain the trim of the vehicle.

In a preferred embodiment of the invention, measuring instruments fitted to the vehicle have their gauges and indicators fitted within a waterproof container, the container having a transparent cover through which the gauges and indicators are visible, a television camera fitted within the vehicle being directable onto the cover of the container, and the camera being adapted to be connected to a television system, such that readings of the gauges and indicators may be remotely taken by viewing a television monitor connected to said television system.

Preferably, embodiments of the invention will also include thrusters for positioning of the vehicle, particularly during lowering of the vehicle on an umbilical cable.

Vehicles in accordance with the invention can be fitted with various types of instrumentation such as temperature, pressure and flow sensors to measure water ambient conditions, sonar for detection of submerged objects and television cameras for remote viewing of work in progress. The vehicles are also preferably fitted with gripping arms and manipulators for performing various tasks such as lifting, moving, positioning and connecting of equipment, and recovery of materials.

In a second mode of operation of the ROV of the present invention, the clump weight is selected to be only just sufficiently heavy to overcome the positive buoyancy of the ROV, such that the ROV can be made to "free swim" by moving the clump weight to alter the attitude of the ROV and then using the thrusters to manoeuvre the ROV both vertically and horizontally.

BRIEF DESCRIPTION OF THE DRAWINGS

Embodiments of the invention will now be described, by way of example, with reference to the accompanying drawings, wherein.

BEST MODE FOR CARRYING OUT THE INVENTION

Figure 1:
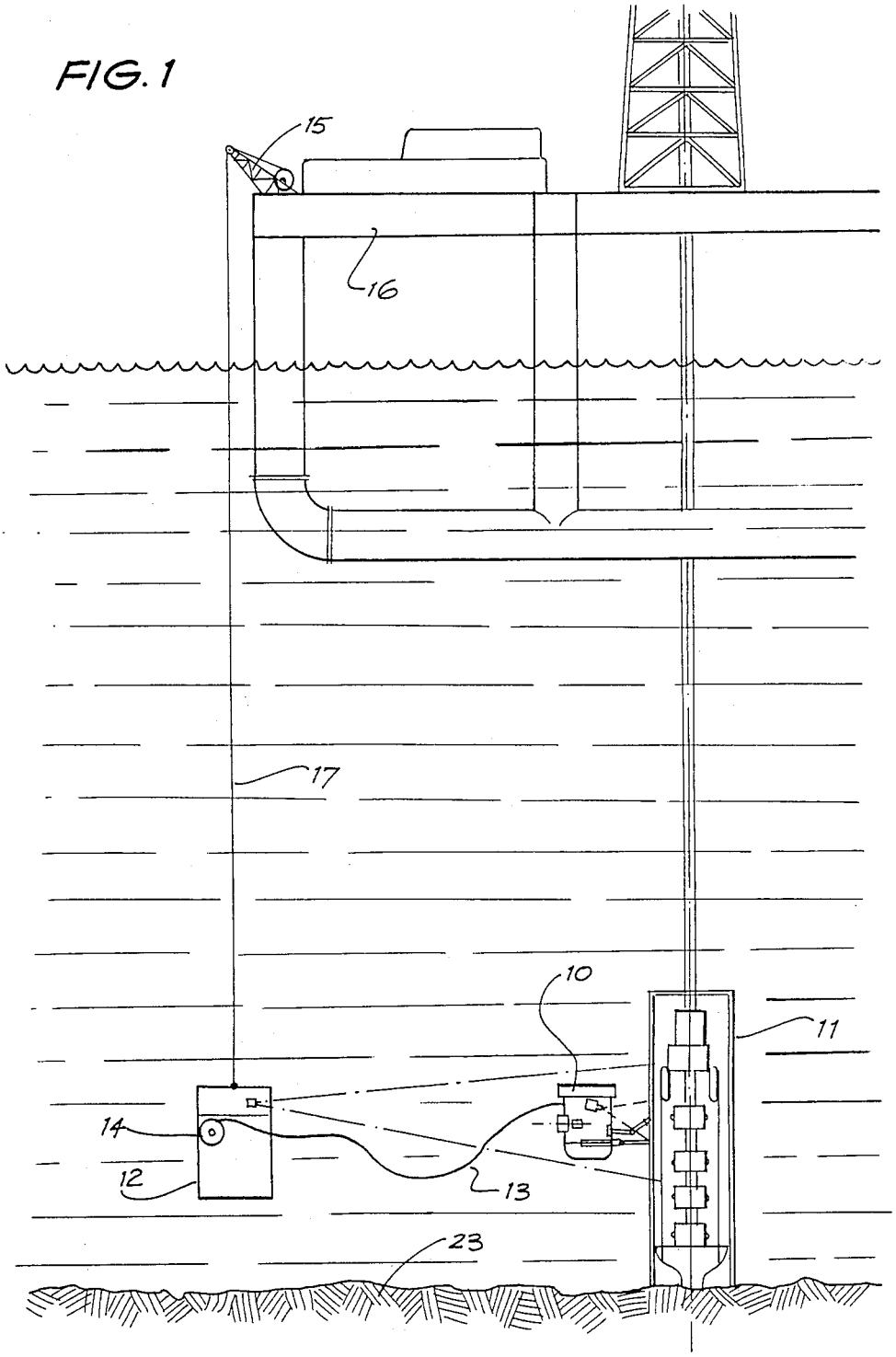
FIG. 1 schematically illustrates a prior art ROV in use.

Referring now to FIG. 1, a prior art ROV 10 is illustrated performing a task around the stack 11 of a deep sea drilling rig. The ROV 10 is teathered to a deployment cage 12 by a cable 13 which is stored on a drum 14 and rolled out as required. The deployment cage 12 is in turn suspended from a derrick 15 on the drilling platform 16 by an umbilical cable 17.

With the prior art system of FIG. 1 the deployment cage 12 will be subject to a heaving motion as a result of the movement of the platform 16, from which it is suspended, in response to the action of wind and waves upon the platform. The ROV 10 is decoupled from the heaving motion of the cage 12 by being free swimming and only connected to the cage by the teather 13. However, this necessitates that the ROV 10 have substantially neutral buoyancy in order that it does not either sink to the sea bed or float to the surface, and similarly it is necessary that the teather 13 also has substantially neutral buoyancy.

As a result of the neutral buoyancy of the ROV 10, its lifting capacity is relatively low, the ROV having to alter its own buoyancy to counteract the negative buoyancy of the object being lifted. Typically, prior art ROVs of the type illustrated in FIG. 1 are capable of lifting loads in the order of only 100 kilograms.

The need to provide neutral buoyancy in the teather 13 also leads to difficulties, in that signal wires running through the teather must be of a light guage, and therefore the teather will be fragile. As a result, the high incidence of the teather becoming snagged will lead to breakages of signal wires in the teather, or breakages of the teather itself, leaving the ROV at best incapable of performing all of its functions and at worst totally stranded on the sea bed. In either case, the ROV will require costly and time consuming repairs and in the case where the ROV is stranded there is the added expense of having to recover the ROV from the sea bed.

Figure 2:
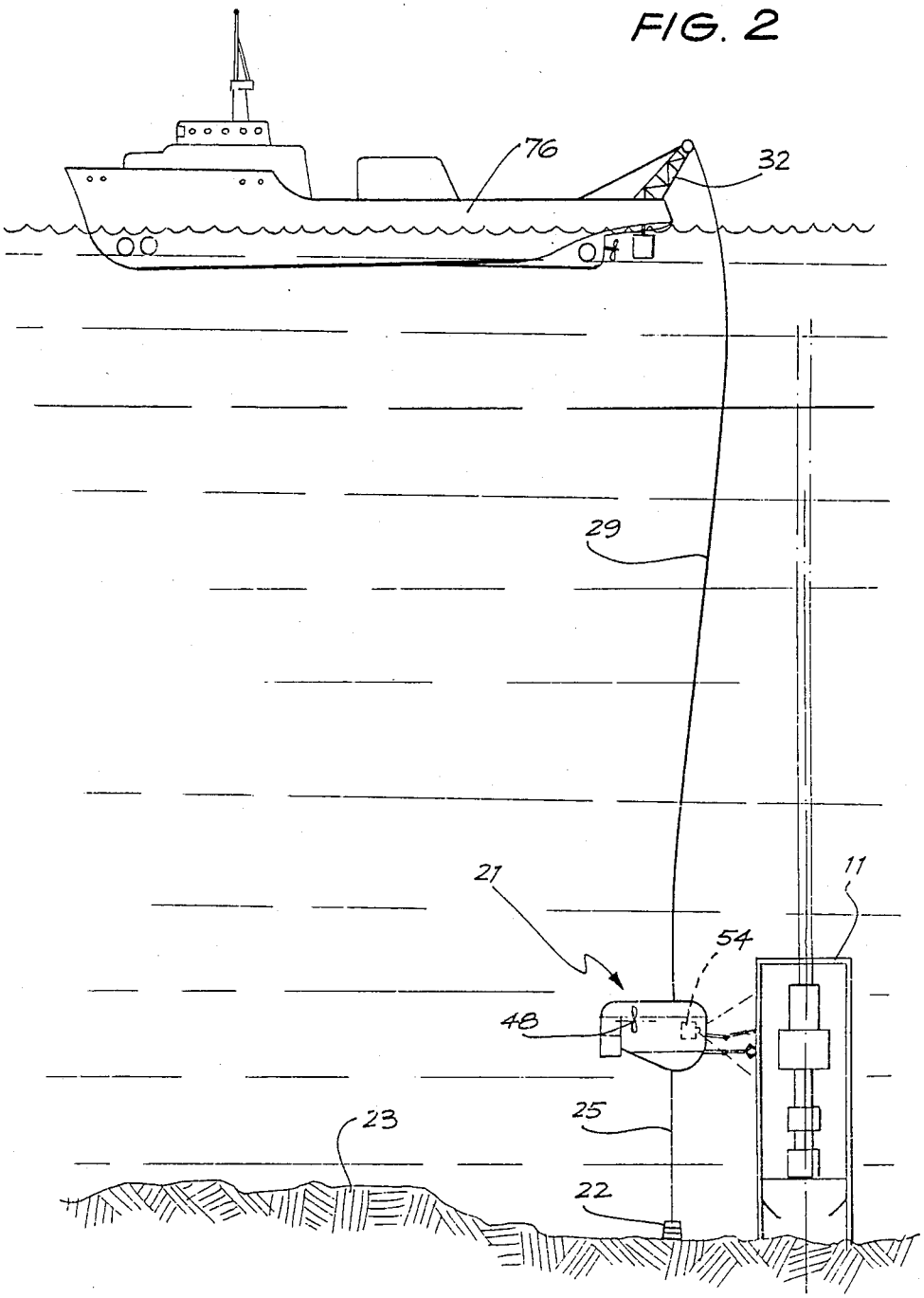
FIG. 2 schematically illustrates an ROV of the present invention in use in a first mode of operation.

Turning now to FIG. 2, an embodiment of an ROV 21, according to the present invention is illustrated in use about the stack 11 of a deep sea drilling rig. This ROV has a positive buoyancy and is held in position relative to the sea bed by a clump weight 22 to which the ROV is attached by a cable 25. With this arrangement it is possible to produce an ROV which has a lifting capacity of in the order of 2 tonnes.

The ROV is lowered into position on the end of an umbilical cable 29 from a derrick 32 on the support vessel 76 and once the ROV or its clump weight reaches the sea bed 23, the umbilical cable is paid out a little further to ensure that the ROV is completely decoupled from the heaving motion of the support vessel. As the weight of the umbilical cable 29 is not a significant factor, the overall structure of the umbilical cable, and the signal wires carried therein, can be made sufficiently strong to withstand heaving motion of the surface vessel without affecting the performance of the ROV, which has ample reserve buoyancy to support the small portion of the umbilical which is not supported by the surface vessel. Once the ROV 21 is anchored to the bottom by its clump weight 22 the height of the ROV is adjusted, relative to the sea bed, by winding cable 25 in or out on a drum 45 (see FIGS. 3 and 4) within the ROV.

As the ROV 21 has only one clump weight 22, unrestricted rotation is possible when required by the task being performed. The orientation of the ROV 21 is held stable and altered when necessary by thrusters 48, 49 which also provide a degree of mobility about the position immediately above the clump weight 22.

Figure 3:
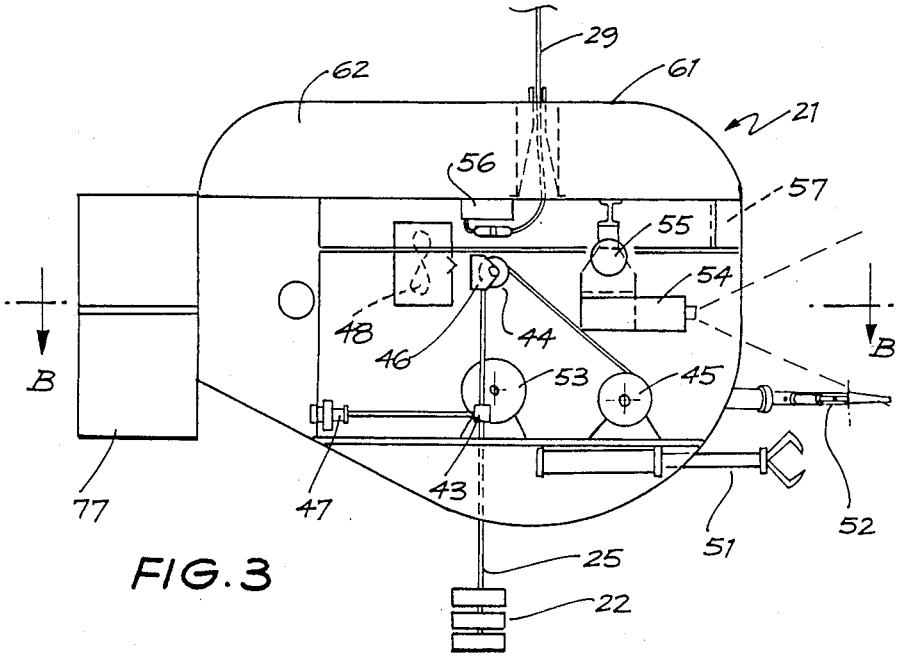
FIG. 3 schematically illustrates an ROV according to an embodiment of the invention in sectional elevation.

The first ROV 21 is illustrated in greater detail in FIG. 3 and comprises an outer housing 61 having a towable shape, floatation cells 62 being located in the upper porition thereof. The clump weight 22, which is variable and disposable, is attached to the ROV by a cable 25 which passes through a cable guide 43 and over a pulley 44 before being taken up on a winch 45, tension being maintained in the cable 25 by a brake 46.

The position of the cable guide 43 in the ROV is variable both in the fore and aft and transverse directions by way of hydraulic cylinders 47, thereby allowing the attitude of the ROV to be adjusted to compensate for unbalanced loads, and also to provide a small degree of control over the position of the ROV relative to the clump weight 22. For large positional changes of the ROV relative to the clump weight 22, thrusters 48 and 49 are provided which allow control over position and orientation. It has been found that only two thrusters are required to provide complete manoeuvrability in the ROV of the present invention whereas typically 5 thrusters are required to provide satisfactory control of the prior art neutral buoyancy ROVs.

The ROV of FIG. 3 is fitted with a grabber arm 51 and a pair of manipulators 52 which can be used for carrying and for performing maintenance tasks around the base of the drilling rig. The grabber arm 51 can also be used to clamp the ROV to the part of the structure upon which it is working, in which case the thrusters can be shut down to conserve power. The grabber arm 51 and manipulators 52 are driven by a hydraulic pump 53.

Operations performed by the ROV are monitored on board the surface vessel by way of a closed circuit television system, the camera 54 of which is mounted on pan and tilt mechanisms 55, the video signals and signals controlling the cameras and the pan and tilt mechanisms travelling between the ROV and the surface vessel via the electrial cables incorporated into the umbilical cable 29. Electrical wiring in the umbilical 29 is terminated in junction boxes 56 located throughout the ROV and from which wiring runs to the various electrical equipment in the ROV.

It is usual in ROVs to include a large amount of instrumentation to allow the monitoring of ambient conditions in the surrounding sea water as well as the status of equipment within the ROV. In prior art ROVs this instrumentation is wired via the umbilical cable 29 to the surface vessel where gauges and readouts for each of the instruments are provided, however, this arrangement requires the umbilical cable to carry a large number of signals, either via discrete wiring, or by using a complex multiplexing system. The ROV illustrated in FIG. 3, on the other hand, overcomes this problem by incorporating an instrument can 57 in which the gauges are mounted, the can having a transparent face through which the gauges can be read, and the television camera 54 being able to be directed at the can 57 such that the gauges can be read via the television monitors on the surface vessel.

The clump weight 22 is both variable and disposable, additional weight being added to the ROV when operating in strong currents and tides, while releasability of the clump weight allows the ROV to be floated freely to the surface with whatever payload it may be carrying.

It has also been found that the ROV of the present invention is less dependent upon the use of devices for automatically maintaining the ROVs heading and height, particularly while operating off a clump weight, whereas prior art ROVs are heavily dependent upon such devices to make the vehicle easily manageable.

Figure 4:
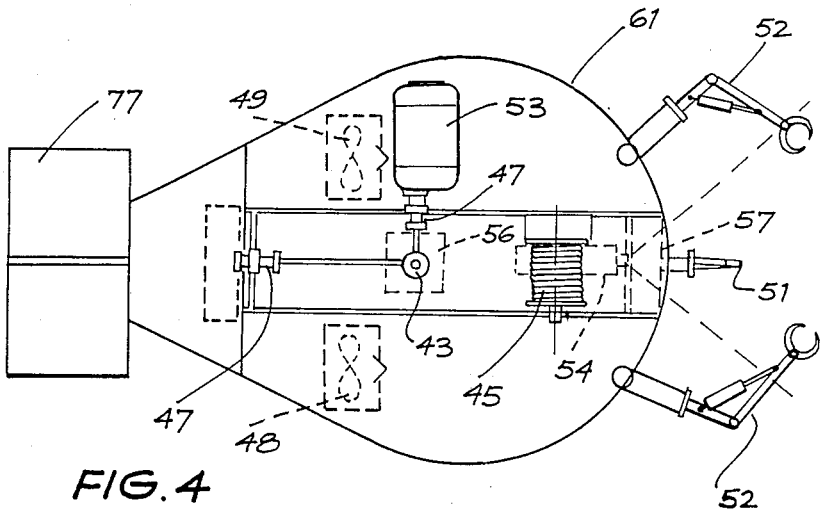
FIG. 4 schematically illustrates a sectional plan view of the ROV, when viewed through section line B—B of FIG. 3.
Figure 5:
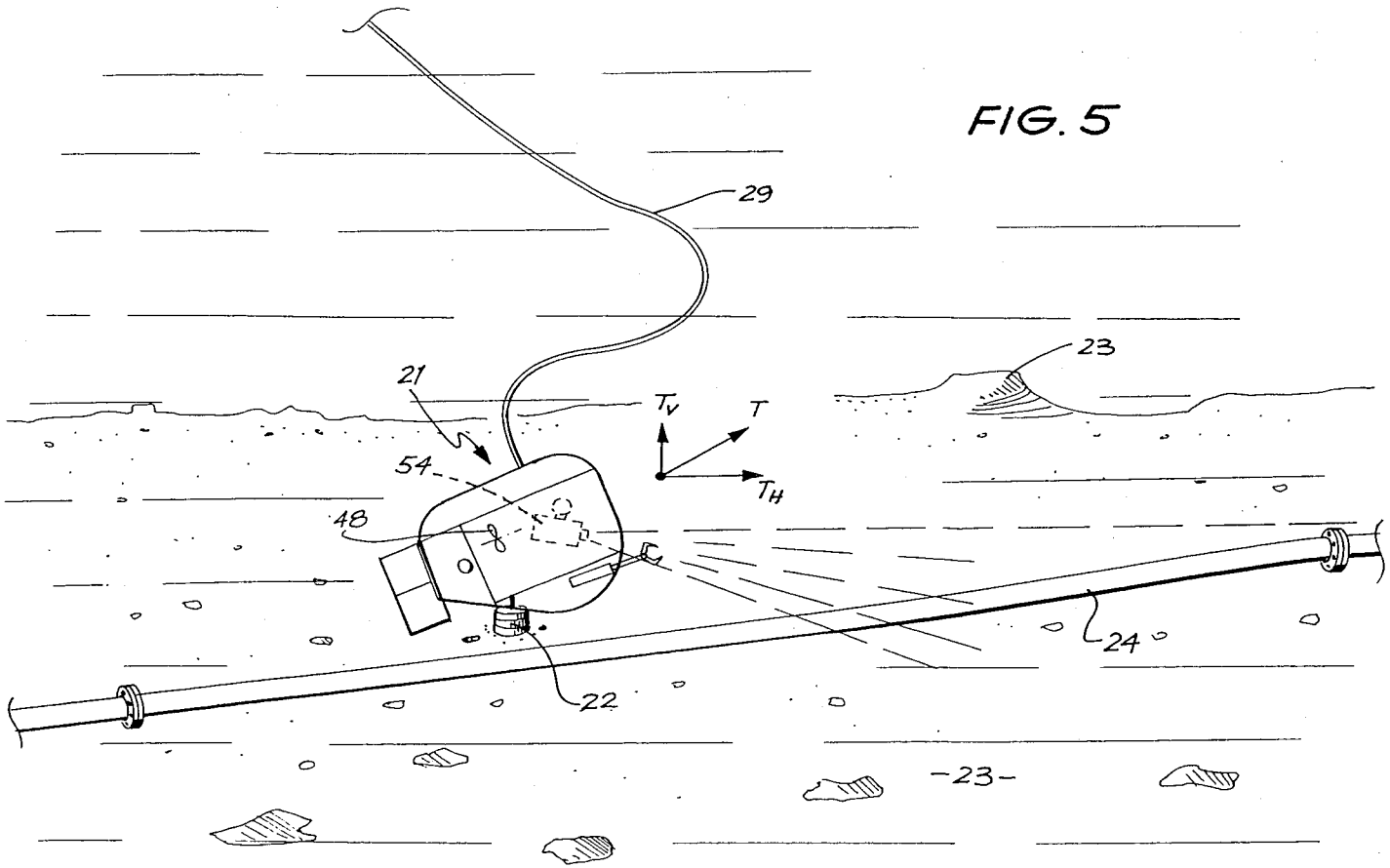
FIG. 5 schematically illustrates the ROV of FIGS. 2 & 3 in a second mode of operation.

Referring to FIG. 5, the ROV of FIG. 3 and 4 may also be operated in a "free swimming" mode, wherein the clump weight 22 is selected to be slightly greater than that required to balance the positive buoyancy of the ROV. Under these circumstances, with the cable 25 fully wound in, such that the clump weight is held immediately under the ROV, the ROV will sink to the bottom. However, by moving the clump weight, by way of the cable guide 43, the attitude of the ROV can be altered. As illustrated in FIG. 5, when the clump weight 22 is moved to the rear of the ROV, the ROV assumes a bow up attitudes such that operations of the thrusters 48, 49 has the effect of providing both a vertical component $T_V$ and a horizontal component $T_H$ of the thrust T thereby allowing the ROV to both lift off of the sea bed 23 and to move forward. In this mode, the ROV is able to "free swim" and in FIG. 5 it is illustrated following an undersea pipeline 24. While free swimming, the camera 54 can be used to scan the bottom while at the same time providing the "eyes" which allow the ROV to be guided along the sea bed. While free swimming, the umbilical 29 is left slack to prevent inhibition of the free swimming movement of the ROV, while the support vessel on the surface shadows the movement of the ROV.

Figure 6:
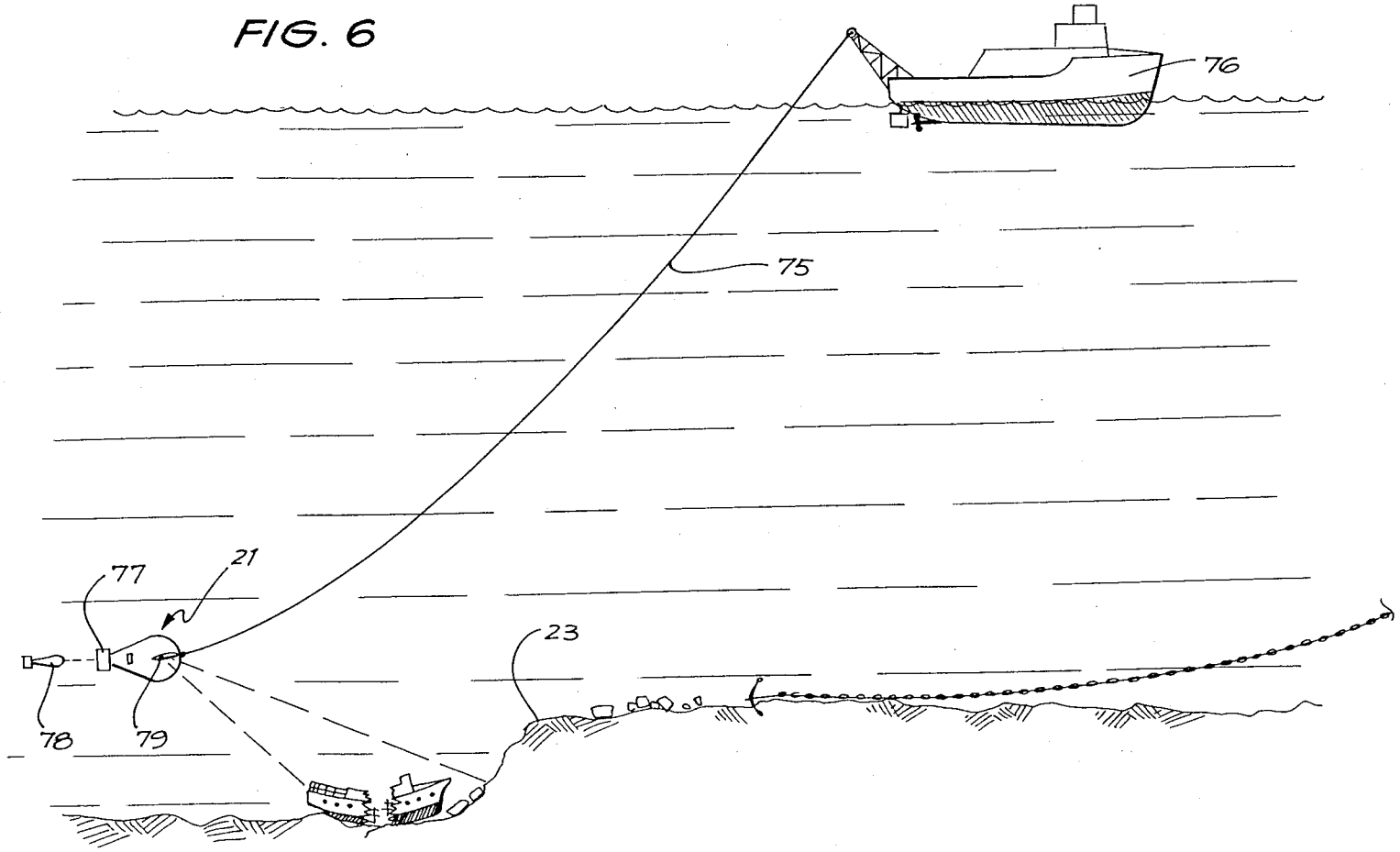
FIG. 6 schematically illustrates the ROV of FIGS. 2 and 3 in a third mode of operation

Turning now to FIG. 6, the ROV of FIG. 3 and 4 may also be operated in a towed configuration, in which the ROV 21 is towed behind a surface vessel 76 by a cable 75 through which the necessary electrical wiring is carried, as for the umbilical cable of FIG. 3. In this mode the ROV must be weighted to provide substantially neutral buoyancy and tail fin assembly 77 acts to keep the ROV directionally stable during towing. Aquaplanes 79 can also be provided on the sides of the ROV to control the depth at which it travels under tow, however, depth can also be controlled by using the thrusters, reverse thrust causing the ROV to rise by placing more drag on the tow line, while forward thrust causes the ROV to sink under its own weight.

While being towed, the camera within the ROV 21 can be used to observe the sea bed 23, however, a magnetometer 78 can also be towed behind the ROV to locate objects on and below the sea bed which have a magnetic signature.

Towed operation has particular advantages during site survey work where a large area of seabed must be scanned. Under these conditions manoeuvrability is not as important and a towed ROV is able to cover a larger area than a free swimming ROV over a given period of time. By providing the ROV of the present invention with a towable shape, it is readily adaptable to operating off a clump weight, free swimming operation and towed operation, whereas the prior art free swimming ROV is not readily adaptable to other modes of operation.

It will be recognised by persons skilled in the art that numerous variations and modifications may be made to the invention as described above without departing from the spirit or scope of the invention as broadly described.

I claim:

1. A remotely operated submersible vehicle comprising positive buoyancy means, a winch, a cable stored on said winch and passing through guide means, said cable being adapted to have a clump weight attached to a free end thereof such that, when said clump weight is made sufficiently heavy to overcome the buoyancy of the positive buoyancy means, the vertical position of the vehicle, from a seabed over which it is operating, can be adjusted by winding cable onto, or off from said winch, the guide means being horizontally movable within the vehicle to maintain the trim of the vehicle.

2. The vehicle of claim 1 wherein two thrusters are provided on the vehicle for manoeuvring and positioning thereof, said thrusters being located on opposite sides of a center line of the vehicle and each being directed for substantially fore and aft thrust.

3. The vehicle of claim 1 or 2 wherein said vehicle is provided with an outer housing having a towable shape.

4. The vehicle of claim 3 wherein a tail fin assembly is provided to improve directional stability during towing.

5. The vehicle of claim 3 or 4 wherein aquaplanes are provided for controlling the depth of the vehicle while under tow.

6. The vehicle as claimed in claim 1, wherein said clump weight is disposable and releasably attached to said free end of said cable.

7. The vehicle as claimed in claim 1, wherein control signals to control and monitor the vehicle are provided via an umbilical cable.

8. The vehicle as claimed in claim 1, wherein one or more remotely controlled grabber arms or manipulator arms are provided thereon for manipulating and carrying loads and said trim of said vehicle is adjusted for varying arm position and load weight by moving said guide means.

9. The vehicle as claimed in claim 1, wherein the guide means is longitudinally and transversely movable by way of hydraulic cylinder means.

10. The vehicle as claimed in claim 1, wherein instrumentation for measuring ambient conditions about the vehicle is provided, display means for said instrumentation being located in a waterproof container having a transparent portion through which said display means is visible, a video camera located within the vehicle beingadapted to be directed at said transparent portion to enable remote reading of said instrumentation display means.

11. A method of operating a remotely operated vehicle of the type comprising thrusters for fore and aft propulsion, positive buoyancy means, a winch, a cable stored on said winch and passing through guide means, said cable having a clump weight attached to a free end thereof, said clump weight being sufficiently heavy to overcome the buoyancy of the positive buoyancy means, and said guide means being horizontally movable within the vehicle to maintain trim of the vehicle wherein the clump weight is selected to be only slightly heavier than the weight required to overcome the positive buoyancy means, the clump weight being wound in fully on its cable and the position of the clump weight being adjusted under the vehicle such that the vehicle assumes a bow up attitude whereby the thrusters provide thrust components in the vertical and horizontal directions, the vertical thrust component being used to lift the vehicle off the seabed.

12. A remotely operated submersible vehicle comprising positive buoyancy means, a winch, a cable stored on said winch and passing through guide means, said cable being adapted to have a clump weight attached to a free end thereof such that, when said clump weight is made sufficiently heavy to overcome the buoyancy of the positive buoyancy means, the vertical position of the vehicle, from a seabed over which it is operating, can be adjusted by winding cable onto, or off from said winch, the guide means being horizontally movable within the vehicle to maintain the trim of the vehicle and two thrusters being provided on the vehicle for manoeuvring and positioning thereof the thrustors being located on opposite sides of the vehicle's centre line and each being directed for substantially fore and aft thrust.

13. A remotely operated submersible vehicle comprising positive buoyancy means, a winch, a cable stored on said winch and passing through guide means, said cable being adapted to have a clump weight attached to a free end thereof such that, when said clump weight is made sufficiently heavy to overcome the buoyancy of the positive buoyancy means, the vertical position of the vehicle, from a seabed over which it is operating, can be adjusted by winding cable onto, or off from said winch, the guide means being horizontally movable within the vehicle to maintain the trim of the vehicle, two thrusters being provided on the vehicle for manoeuvring and positioning thereof, the thrustors being located on opposite sides of the vehicle's centre line and each being directed for substantially fore and aft thrust, and one or more remotely controlled grabber arms or manipulator arms being provided on the vehicle for manipulating and carrying loads, the trim of the vehicle being adjusted for moving arm position and load weight by moving the guide means, and said guide means being longitudinally and transversely movable by way of hydraulic cylinder means.

14. A remotely operated submersible vehicle comprising positive buoyancy means, a winch, a cable stored on said winch and passing through guide means, said cable being adapted to have a clump weight attached to a free end thereof such that, when said clump weight is made sufficiently heavy to overcome the buoyancy of the positive buoyancy means, the vertical position of the vehicle, from a seabed over which it is operating, can be adjusted by winding cable onto, or off from said winch, the guide menas being horizontally movable within the vehicle to maintain the trim of the vehicle and two thrusters being provided on the vehicle for manoeuvring and positioning thereof the thrustors being located on opposite sides of the vehicles's centre line and each being directed for substantially fore and aft thrust and wherein instrumentation for measuring ambient conditions about the vehicle is provided, display means for said instrumentation being located in a waterproof container having a transparent portion through which said display means is visible, a video camera located within the vehicle being adapted to be directed at said transparent portion to enable remote reading of said instrumentation display means.

15. A method of operating a remotely operated vehicle of the type comprising positive buoyancy means, a winch, a cable stored on said winch and passing through guide means, said cable being adapted to have a clump weight attached to a free end thereof, said clump weight being made sufficiently heavy to overcome the buoyancy of the positive buoyancy means, the guide means being horizontally movable within the vehicle to maintain the trim of the vehicle, two thrusters being provided on the vehicle for manoeuvring and positioning thereof the thrustors being located on opposie sides of the vehicle's centre line and each being directed for substantially fore and aft thrust, and the clump weight being selected to be only slightly heavier than the weight required to overcome the positive buoyancy means, the clump weight being wound in fully on its cable and the position of the clump weight being adjusted under the vehicle such that the vehicle assumes a bow up attitude whereby the thrusters provide thrust components in the vertical and horizontal directions, the vertical thrust component being used to lift the vehicle off the seabed.

16. A method of operating a remotely operated vehicle of the type comprising a remotely operated submersible vehicle comprising positive buoyancy means, a winch, a cable stored on said winch and passing through guide means, said cable being adapted to have a clump weight attached to a free end thereof, said clump weight being made sufficiently heavy to overcome the buoyancy of the positive buoyancy means, the guide means being horizontally movable within the vehicle to maintain the trim of the vehicle, two thrusters being provided on the vehicle for manoeuvring and positioning thereof the thrustors being located on opposite sides of the vehicle's centre line and each being directed for substantially fore and aft thrust, one or more remotely controlled grabber arms or manipulator arms being provided on the vehicle for manipulating and carrying loads and the trim of the vehicle being adjusted for moving arm position and load weight by moving the guide means, the guide means being longitudinally and transversely movable by way of hydraulic cylinder means, and the clump weight being selected to be only slightly heavier than the weight required to overcome the positive buoyancy means, the clump weight being wound in fully on its cable and the position of the clump weight being adjusted under the vehicle such that the vehicle assumes a bow up attitude whereby the thrusters provide thrust components in the vertical and horizontal directions, the vertical thrust component being used to lift the vehicle off the seabed.

17. A method of operating a remotely operated vehicle of the type comprising positive buoyancy means, a winch, a cable stored on said winch and passing through guide means, said cable being adapted to have a clump weight attached to a free end thereof, said clump weight being made sufficiently heavy to overcome the buoyancy of the positive buoyancy means, the guide means being horizontally movable within the vehicle to maintain the trim of the vehicle, two thrusters being provided on the vehicle for manoeuvring and positioning thereof the thrustors being located on opposite sides of the vehicle's centre line and each being directed for substantially fore and aft thrust, instrumentation for measuring ambient conditions about the vehicle being provided with display means located in a waterproof container having a transparent portion through which said display means is visible, a video camera located within the vehicle being adapted to be directed at said transparent portion to enable remote reading of said instrumentation display means, and the clump weight being selected to be only slightly heavier than the weight required to overcome the positive buoyancy means, the clump weight being wound in fully on its cable and the position of the clump weight being adjusted under the vehicle such that the vehicle assumes a bow up attitude whereby the thrusters provide thrust components in the vertical and horizontal directions, the vertical thrust component being used to lift the vehicle off the seabed.

* * * * *